US005581266A

United States Patent [19]

Peng et al.

[11] Patent Number: 5,581,266

[45] Date of Patent: Dec. 3, 1996

[54] PRINTED-CIRCUIT CROSSED-SLOT ANTENNA

[76] Inventors: Sheng Y. Peng, 731 Inspiration La., Escondido, Calif. 92025; Wong Foy, 7844 Mission Bonita Dr., San Diego, Calif. 92120

[21] Appl. No.: 544,578

[22] Filed: Oct. 18, 1995

Related U.S. Application Data

[63] Continuation of Ser. No. 357,071, Dec. 15, 1994, abandoned, which is a continuation of Ser. No. 281, Jan. 4, 1993, abandoned.

[51] Int. Cl.[6] ..... H01Q 1/38; H01Q 13/10

[52] U.S. Cl. ..... 343/770; 343/767

[58] Field of Search ..... 343/770, 700 MS, 343/767; H01Q 1/38, 13/00, 13/10

[56] References Cited

U.S. PATENT DOCUMENTS

| | | | |
|---|---|---|---|
| 2,555,443 | 6/1951 | Harvey | 343/767 |
| 3,971,032 | 7/1976 | Munson et al. | 343/770 |
| 4,531,130 | 7/1985 | Powers et al. | 343/767 |
| 4,590,478 | 5/1986 | Powers et al. | 343/770 |
| 4,672,386 | 6/1987 | Wood | 343/770 |
| 4,903,033 | 2/1990 | Tsao et al. | 343/700 MS |
| 4,922,263 | 5/1990 | Dubost et al. | 343/700 MS |
| 5,202,697 | 4/1993 | Bonebright et al. | 343/770 |

FOREIGN PATENT DOCUMENTS

| | | | |
|---|---|---|---|
| 2147744 | 5/1985 | United Kingdom | 343/700 MS |

*Primary Examiner*—Michael C. Wimer
*Attorney, Agent, or Firm*—Gilliam, Duncan & Harms

[57] ABSTRACT

An improved printed-circuit cross-slotted antenna for satellite communication. The antenna comprises a dielectric substrate covered with conductive material on a first ground plane side and on a second radiating side. The periphery edges of the first and second sides electrically interconnect the sides. The radiating side includes a first and a second slot with the conductive material removed and the substrate exposed. Conductors pass through the crossed slot antenna from the first side to the second side with connections only to the second side. Electrical signals to be radiated from the second side are connected to the connectors. The second side radiates the Electrical signals in a pattern according to the configuration of the slots.

10 Claims, 1 Drawing Sheet

PRINTED-CIRCUIT CROSSED-SLOT ANTENNA

"This application is a continuation of application Ser. No. 08/357,071 filed on Dec. 15, 1994 now abandoned, which is a continuation application 08/000,281 filed on Jan. 4, 1993 ", now abandoned.

FIELD OF INVENTION

This invention relates to radio wave communications and antennas, and more specifically to-plural slot type antennas for satellite communications.

BACKGROUND OF THE INVENTION

The closest prior art can be found in U.S. Pat. No. 4,916,457. This patent by two of the three inventors of the instant invention is directed to a similar type antenna which teaches a printed circuit cavity-backed crossed-slotted conductive element having two legs of each slot coupled by stripling feeders to a radio communication device. The feeders supply the radio frequency signal with a 180 degree phase shift in order to cancel cross-coupling from one leg to another around the intersection. The conductive element and the stripling feeders are mounted on separate substrates which are sandwiched together with other elements to provide shielding and mechanical protection. The crossed-slot design reduces space and structure required for mobile application while achieving good performance. When mounted in an array, the crossed slot antenna may be directionally tuned to a specific satellite/frequency/direction via pin diode phase shifters.

Additional prior art related antennas can be found in the references cited in the above referenced United States patent.

The instant invention is an improvement to the type of printed-circuit crossed-slot antenna taught by the above referenced United States patent.

SUMMARY OF THE INVENTION

The invention is directed to a uniquely configured printed-circuit crossed-slot antenna which comprises a non-metallic substrate with the entire outer surface including the edge surfaces coated with a thin layer of an electrically conductive material such as, aluminum, copper, silver, gold, platinum or other suitable high electrical conductive materials metallic or otherwise. The cavity radiating side of the substrate includes a crossed-slot as defined in U.S. Pat. No. No. 4,916,457 with differently configured slot ends. Plated through apertures which begin at and are insulated from the conductive material covered side of the non-metallic substrate electrically connect to the conductive material portion of the crossed-slot side of the non-metallic substrate. These apertures provide radio frequency energy into or out of the cavity and in turn, this energy being received or radiated out to space from the crossed-slots. The apertures are spaced apart substantially 90 degrees and are positioned substantially 45 degrees from a longitudinal and transverse center lines through the slots. The central conductor of the signal feed elements of four connectors passes through without electrical contact with the conductive covered side of the conductive material covered or ground plane side of the substrate to the slotted radiating side thereof. One central conductor of the feed element is electrically connected to each of the plated through apertures for excitation of the antenna cavity formed by the crossed-slots. The ground plane connection of each of the connectors is electrically connected to the conductive material of the solid material or ground plane side of the substrate and the signal feed elements are electrically connected to the conductive material of the radiating side of the antenna. The operating frequency of the antenna cavities is determined by the dimensions of the substrate, slot configuration and the thickness and dielectric rating of the substrate medium. The individual elements, ie. the substrate defined above, can be electrically formed as an array, as defined in the above cited United States Patent.

An object of this invention is to provide a more simplified antenna cavity structure limited to a single layer substrate.

An other object of this invention is to provide a probe fed crossed-slot antenna.

An other object of this invention is to provide a crossed-slot antenna with increased bandwidth over the prior art crossed-slot antennas.

Yet other object of this invention is to provide a crossed-slot antenna with increased efficiency over the prior art crossed-slot antennas.

An other object of this invention is to provide a simplified antenna structure with reduced manufacturing costs.

These and other objects and advantages of the present invention will become apparent to those skilled in the art after considering the following detailed specification in which the preferred embodiment is described in conjunction with the accompanying drawing Figures.

DESCRIPTION OF THE PREFERRED EMBODIMENTS

Figure 2:
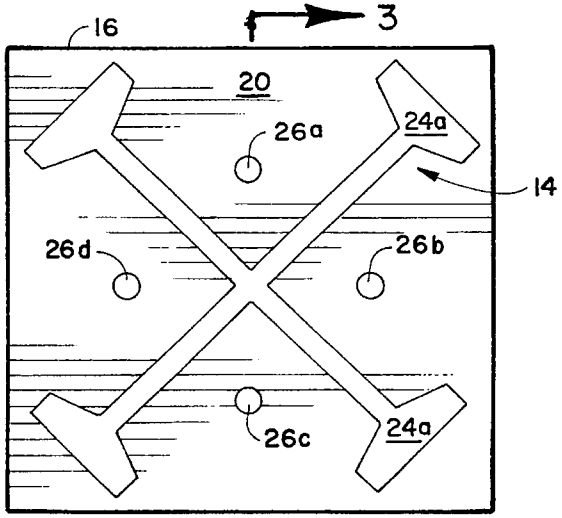
FIG. 2 depicts a plan view of the radiating side of the crossed-slot antenna of FIG. 1.
Figure 5:
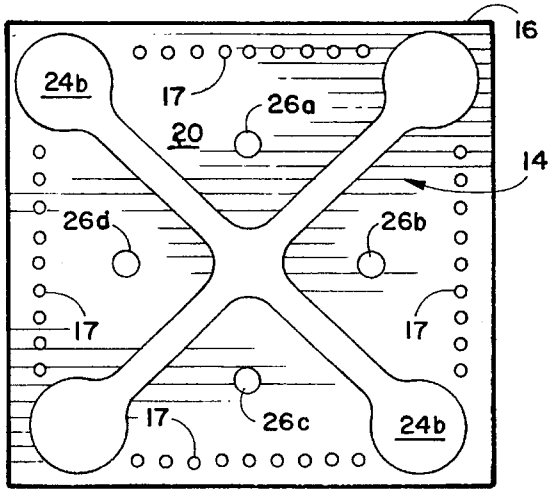
FIG. 5 depicts a plan view of the radiating side of the crossed-slot antenna of FIG. 4.
Figure 3:
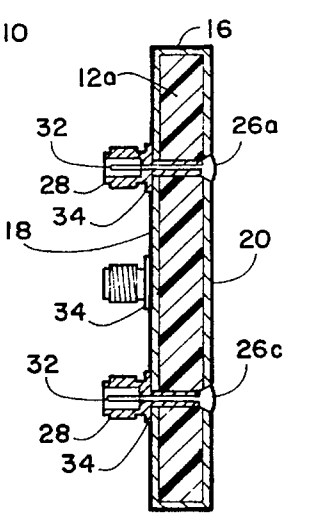
FIG. 3 is a view of the crossed-slot antenna of FIGS. 1 and 2.
Figure 6:
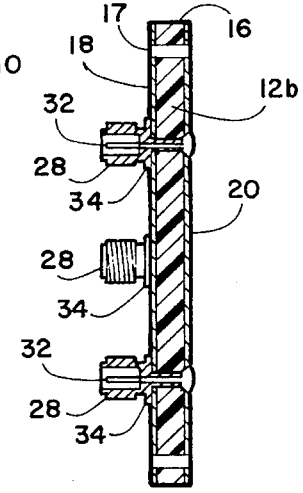
FIG. 6 is a view of the crossed-slot antenna of FIGS. 4 and 5.
Figure 1:
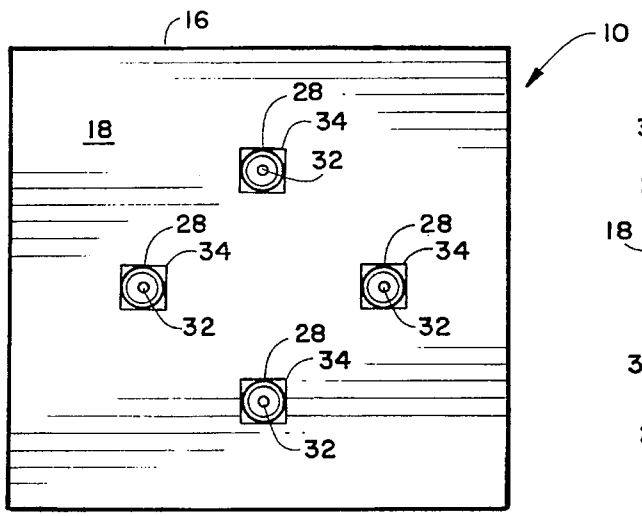
FIG. 1 depicts a plan view of the ground plane side of a first embodiment of the crossed-slot antenna of the invention.
Figure 4:
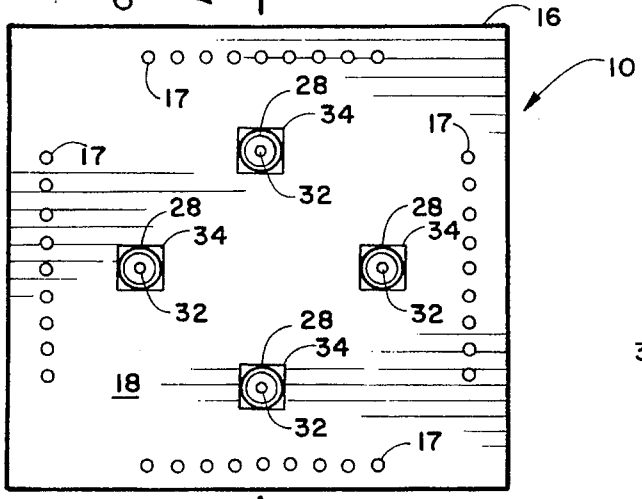
FIG. 4 depicts a plan view of the ground plane side of a second embodiment of the crossed-slot antenna of the invention.

Referring now to the drawing Figures and specifically to drawing FIGS. 1–3 which depict the first preferred embodiment of the crossed-slot antenna 10 of invention and drawing FIGS. 4–6 which depict a second embodiment of the crossed-slot antenna. The antenna 10 comprises a central dielectric substrate 12*a*, 12*b* (see drawing FIG. 6) formed from a non-metallic insulation material having a suitable dielectric for the desired resonate frequency of the antenna cavity 14. The thickness of the dielectric 12*a* and 12*b* is determined by the type of dielectric material and the frequency at which the antenna is designed to operate. The surfaces of the entire substrate including the edges 16 thereof are conductively interconnected with a suitable highly electrically conductive material such as, for example, aluminum, cooper, silver, gold, platinum or the like. The two opposed surfaces covered by the highly electrically conductive material are either interconnected by plating the substrate periphery edges 16 or plated through holes 17 around the periphery edges between the two surfaces of the substrate by a process well known in the printed circuit art. One surface 18 (the ground plane surface) is completely covered with conductive material and the opposite surface 20 (radiating surface) is likewise completely covered with conductive material except for the crossed-slot cavity 14 formed by removing the conductive material coating from the substrate. The cavity is formed by crossed-slots with selectively configured slot distal ends 24*a*, 24*b*. As shown in drawing FIG. 2, the ends 24*a* of the slots are rectangular in form while the distal ends of the slots 24*b* are shown in FIG. 5 are curvilinear in form. Various different slot end configurations can be chosen for various different specific radiation properties.

A plurality of four plated through apertures 26*a*, 26*b*, 26*c* and 26*d* extend and are insulated from the surface 18 to the surface 20. The plated through apertures are electrically insulated from the surface 18 by means of spacing or insulation material (not shown) and connect at their opposite ends to the surface 20. The apertures 26 are substantially spaced 90 degrees apart along approximately the 0 degree (referenced from the top of the drawing Figures), 90 degree, 180 degree and 270 degree axis of the substrate 10 with the slots intersecting at their center and the center of the substrate with one slot extending between the second to third quadrant and the second slot extending between the first and third quadrant. The slots are positioned substantially equally between the apertures.

A conventional microwave connector 28 with a central connector 32 interconnected to the plated through aperture and a conductive lead therefrom may extend through the aperture while being electrically insulated from surface 18 and electrically connected to the surface 20. The outer shell 34 of connector 32 is electrically connected to the surface 18 of the ground plane side of the substrate.

The apertures 26*a*–26*d* may be spaced at different selected distances from the outer edge of the substrate as shown in drawing FIGS. 1, 2, 4 and 5. The spacing of the apertures like the outer distal end configuration of the slots and selection of the dielectric material determine the frequency of the antenna 10 and the configuration of the transmitted wave pattern therefrom.

As fully discussed in the fore mentioned U.S. Pat. No. 4,916,457, the legs of each slot are fed by a pair of central conductors (positive) 32. A first pair of central conductors supply radio frequency signal, as taught by the patent or in any other manner suitable for the purpose intended, to each leg of each slot 180 degrees out of phase from the opposite leg central conductors.

The conductive material can be plated on the substrate as in stripline technology, adhered thereto or attached thereto in any manner suitable for the purpose intended.

As can be seen in drawing FIG. 5, the intersection of the two legs includes a rectilinear configured transition area 36 which is designed to effect the operating frequency of the antenna. Other transition configurations can be used at the intersection of the legs to effect yet different radiation configurations.

It should be understood that the antenna, as herein after claimed, can be used for receiving radio frequency signals as well as for transmitting radio frequency signals.

While the geometry of the preferred embodiments have been described many other geometries could be devised to practice this invention.

While the preferred embodiments of the invention have been shown and described, changes and modifications may be made without departing from the spirit and scope of the appended claims without departing from the spirit and scope of this invention.

What is claimed is:

1. A crossed-slot antenna connectable to a radio communication device for transmitting or receiving a radio frequency signal, said cross-slot antenna comprising:

a single layer dielectric substrate, said substrate having a ground plane side, a radiating side and periphery edges around said single layer substrate;

electrically conductive material covering the outer surfaces of said ground plane side and radiating side with the ground plane and radiating sides electrically interconnected completely around said periphery edges by electrically conductive material;

said radiating side of said substrate having first and second symmetrical slots formed by selected removal of said electrically conductive material exposing said outer surface of said dielectric substrate within said slots exposing said dielectric substrate and forming an open cavity within said conductive material thereby, said slots being along the some plane and crossed at substantially 90 degrees in a cruciform configuration forming a centrally positioned cross-over area and each of said slots having an enlarged surface area at their distal ends, said enlarged surface area being greater in surface area than the transverse width of said slots between said distal ends;

first plated through apertures adjacent to said periphery edges extending through said substrate, said apertures being electrically connected to said electrically conductive material on both sides of said substrate; and microwave connectors substantially equally spaced and symmetrically positioned around said cross-over area, having an at ground and an above ground connection, said at ground connection being connected to the conductive material of said ground plane side and said above ground connection passing through said substrate and electrically connected to said conductive material on said radiating side thereof whereby a radio frequency signal applied to said above ground connection radiates from said radiating side in a radiation pattern according to the configuration of said open cavity.

2. The antenna as defined in claim 1 wherein said substrate is of strip-line construction with said ground plane side and said radiating side interconnected at their edges by plated second through holes.

3. The antenna as defined in claim 1 wherein said conductive material is a metal selected from the group comprising silver, copper, gold, aluminum and platinum.

4. The antenna as defined in claim 1 wherein said symmetrical slots have enlarged distal ends.

5. The antenna as defined in claim 4 wherein said enlarged distal ends are curvilinear.

6. The antenna as defined in claim 4 wherein said distal ends are rectilinear.

7. The antenna as defined in claim 1 wherein said symmetrical slots are in the form of a cross with their cross-over area being enlarged.

8. The antenna as defined in claim 7 wherein said enlarged cross-over area is rectilinear.

9. The antenna as defined in claim 7 wherein said enlarged cross-over area is curvilinear.

10. A cross-slot antenna connectable to a radio communication device for transmitting or receiving a radio frequency signal, said cross-slot antenna comprising:

a single layer solid dielectric substrate, said substrate having a ground plane side, a radiating side with the ground plane side and radiating side with the ground plane and radiating side periphery edges around said single layer substrate;

electrically conductive material covering the outer surface of said ground plane side and radiating side with the ground plane and radiating sides electrically interconnected completely around said periphery edges with said electrical conducting material;

said radiating side of said substrate having first and second symmetrical slots formed by selected removal of said electrically conductive material exposing an outer surface of said dielectric substrate within said slots exposing said dielectric substrate and forming an open cavity thereby, said slots being on the same plane and crossed at substantially 90 degrees in a cruciform configuration forming a centrally positioned cross-over area and each of said slots having an enlarged surface area at their distal ends, said enlarged surface area being greater in surface area than the transverse width of said slots between said distal ends;

first plated through apertures adjacent to said periphery edges extending through said substrate, said substrate being electrically connected to said electrically conductive material on both sides of said substrate; and microwave connectors substantially equally spaced and symmetrically positioned around said cross-over, area microwave connectors having an at ground and above ground connection, said at ground connection being connected to the conductive material of said ground plane and said above ground connection passing through said substrate and electrically connected to said conductive material on said radiating side thereof whereby a radio signal applied to said above ground connection radiates from said radiating side in a radiation pattern according to the configuration of said open cavity.

* * * * *